United States Patent [19]

Satchell, Jr.

[11] 4,002,556

[45] Jan. 11, 1977

[54] MULTIPLE POINT INJECTION OF HYDROGEN DONOR DILUENT IN THERMAL CRACKING

[75] Inventor: Donald P. Satchell, Jr., Morenci, Ariz.

[73] Assignee: Continental Oil Company, Ponca City, Okla.

[22] Filed: Apr. 12, 1976

[21] Appl. No.: 675,841

[52] U.S. Cl. ..... 208/107; 208/56; 208/132

[51] Int. Cl.[2] ..... C10G 9/14; C10G 13/00; C10G 1/06

[58] Field of Search ..... 208/108, 56, 107, 8, 208/125, 127, 132

[56] References Cited

UNITED STATES PATENTS

| | | | |
|---|---|---|---|
| 2,873,245 | 2/1959 | Thompson et al. | 208/56 |
| 2,953,513 | 9/1960 | Langer | 208/56 |
| 3,238,118 | 3/1966 | Arey et al. | 208/59 |
| 3,583,900 | 6/1971 | Gatsis | 208/8 |
| 3,617,513 | 11/1971 | Wilson et al. | 208/56 |
| 3,711,568 | 1/1973 | Cooper | 208/132 X |

*Primary Examiner*—Delbert E. Gantz
*Assistant Examiner*—G. E. Schmitkons
*Attorney, Agent, or Firm*—Richard W. Collins

[57] ABSTRACT

An improved hydrogen donor diluent cracking process for upgrading hydrogen deficient hydrocarbonaceous materials such as petroleum residua to more valuable liquid distillates. The hydrogen donor diluent, which is a material that has been partially hydrogenated and which readily gives up hydrogen under thermal cracking conditions, is injected into the cracking unit at a plurality of points so that the ratio of the rate of hydrogen transfer to the rate of cracking is more uniform throughout the cracking unit than if all the hydrogen donor diluent is injected with the feed charge to the cracking unit.

5 Claims, 2 Drawing Figures

MULTIPLE POINT INJECTION OF HYDROGEN DONOR DILUENT IN THERMAL CRACKING

BACKGROUND OF THE INVENTION

1 Field of the Invention

This invention relates to the conversion of heavy hydrocarbon oils such as petroleum residua to more valuable liquid distillates by simultaneously cracking and hydrogenating the heavy oils in the presence of a hydrogen donor diluent.

2. Description of the Prior Art

It is known in the art to upgrade hydrogen deficient petroleum residua (resid) by thermally cracking the resid in admixture with a hydrogen donor diluent. The hydrogen donor diluent is a material, generally aromaticnaphthenic in nature, that has the ability to take up hydrogen under mild hydrogenation conditions and to readily release the hydrogen to a hydrogen-deficient resid under thermal cracking conditions. One of the principal advantages of the hydrogen donor diluent cracking (HDDC) process is that it can upgrade resids which are not readily amenable to other conversion processes, and further that it can provide high conversions in the absence of a catalyst and with a minimum of coke deposition. The cracked materials produced by the HDDC process are readily converted to desirable products, and the hydrogen donor diluent can be recycled through the hydrogenation step for reuse in the cracking unit.

The HDDC process is well known in the art, and a comprehensive description of the process, including materials, flows and operating conditions, appears in U.S. Pat. No. 2,953,513. Variations of the HDDC process, particularly as to the makeup of the hydrogen donor diluent, are described in U.S. Pat. Nos. 2,873,245 and 3,238,118. All of the prior art processes utilizing the HDDC step, as exemplified by the abovementioned patents, blend the total diluent charge with the resid charge upstream of the cracking unit. While this technique has proved practical and has enjoyed commercial success, there has been a need for an improved HDDC process which achieves better hydrogen utilization. Such a process is provided by the present invention.

SUMMARY OF THE INVENTION

According to the present invention, improved hydrogen utilization, manifested as reduced hydrogen consumption, is achieved by adding the hydrogen donor diluent in a novel manner to the hydrogen deficient material being thermally cracked. More specifically, a portion of the hydrogen donor diluent is injected into the cracking unit at a point downstream from the resid inlet to the cracking unit. The benefits of the invention are obtained by injecting a substantial portion of the diluent approximately midway through the cracking unit, and as will be explained below, the use of additional injection points provides even better improvement in hydrogen utilization.

DESCRIPTION OF THE PREFERRED EMBODIMENT

Figure 1:
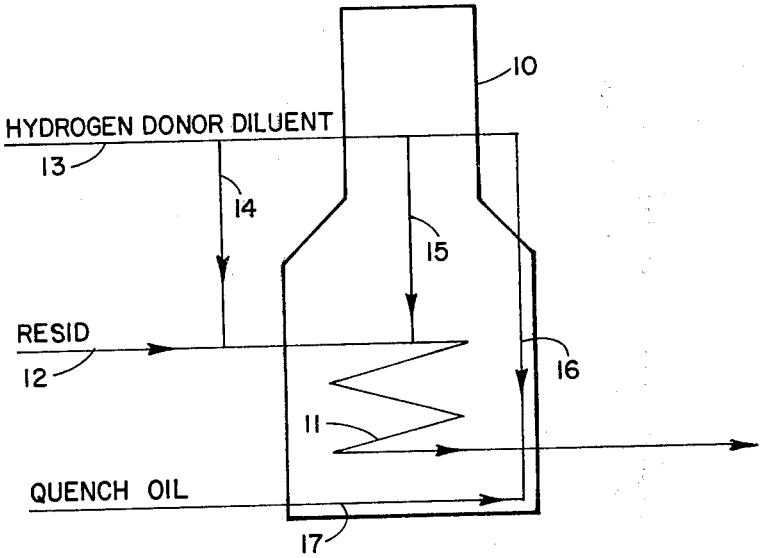
FIG. 1 is a schematic flow sheet illustrating the process of the invention.

The preferred embodiment of the invention will now be described, having reference to FIG. 1 of the drawings, In FIG. 1, a cracking furnace 10 is shown having a cracking coil 11. A feed line 12 is provided for feeding resid into cracking coil 11, and a hydrogen donor diluent feed line 13 is provided with branches 14 and 15 for feeding hydrogen donor diluent to resid feed line 12 and cracking coil 11 respectively. Appropriate controls and valves (not shown) are provided to obtain the desired distribution of hydrogen donor diluent to the respective sections of the cracking furnace 10.

Conventional hydrogen donor diluent cracking conditions are used in the practice of this invention. These include a diluent to feed ratio in the range of 0.1 to 5 volumes per volume, a combined feed rate to provide a residence time in the cracking furnace from 0.25 to 5 hours, a pressure preferably sufficient to maintain liquid phase conditions, and a temperature of from 800°–1,000° F.

The hydrogen donor diluent may be any material which can be partially hydrogenated under mild hydrogenation conditions and which will readily give up hydrogen to the hydrogen-deficient material under thermal cracking conditions. Generally, hydrogen donor diluents function by conveying loosely held hydrogen in the cracking zone, which hydrogen is taken up by the molecular fragments obtained by the thermal cracking of the hydrogen-deficient resid. Hydrogen donor diluents preferably are low value, normally surplusage refinery streams such as certain thermal tars from which lighter thermal cracking products have been distilled. Thermal tars are susceptible to partial hydrogenation under relatively mild conditions, and are an excellent hydrogen donor diluent material. The hydrogen utilization achieved by the use of thermal tar as the hydrogen donor diluent is relatively good, but has not been optimized by prior art HDDC processes. Generally, the hydrogen consumption at a given resid conversion decreases with increasing reactor temperature. However, the tendency of the cracked material to deposit coke also increases with increasing reactor temperature, such that the optimum temperature for a given situation is often a compromise between resid conversion level and coke deposition.

The furnace effluent from a cracking unit has a tendency to deposit coke downstream from the cracking unit if allowed to cool gradually from cracking temperature to about 800° F, and for this reason a quench oil stream is normally added to a cracking unit effluent to cause the effluent to cool rapidly to about 800° F or less. In FIG. 1, quench oil line 17 is provided for this purpose. Alternatively, a portion of the donor diluent may be used as the quench oil, and branch line 16 is shown in FIG. 1 for conveying a portion of the donor diluent to the furnace outlet.

In accordance with the most preferred embodiment of the invention, a hydrogen-deficient resid is charged to cracking furnace 10 through feed line 12, two volumes of diluent for each volume of resid are charged to furnace 10, with about fifty percent of the diluent being charged through line 14 to blend with the resid charge to the furnace and about 50 percent of the diluent being charged through line 14 approximately midway through the cracking coil 11. It will be appreciated that additional injection points could be utilized within the furnace 10, although as a practical matter the benefits provided by additional injection points must be measured against the additional expense and inconvenience of using a larger number of injection points.

In an HDDC process, higher conversions are generally obtainable at higher operating temperatures, such that the process can be optimized by operating at a higher temperature.

The benefits provided by this invention were recognized from an analysis of predicted results obtained by a kinetic model based on experimental results from a laboratory thermal cracker. This kinetic model enabled the calculation of hydrogen consumption for given cracking conditions.

Figure 2:
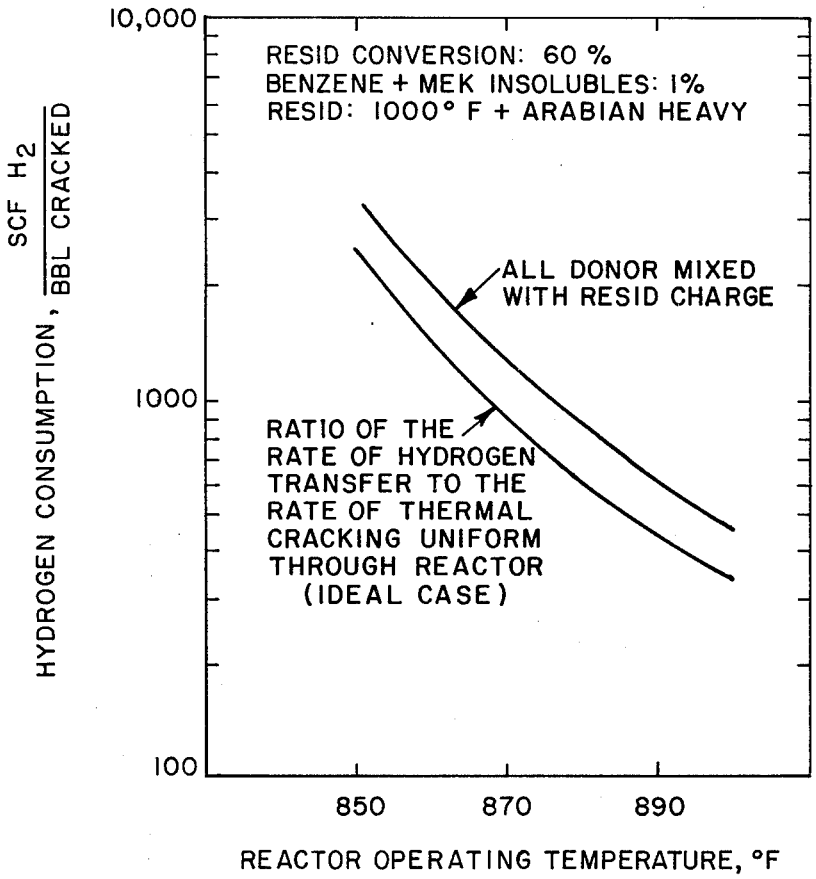
FIG. 2 is a graph illustrating hydrogen utilization for specific operating conditions.

FIG. 2 is a plot showing the hydrogen consumption at various reactor temperatures to obtain a resid conversion of sixty percent with a benzene and methyl ethyl ketone insoluble level of 1 percent for a heavy Arabian resid when all of the hydrogen donor diluent is mixed with the resid charge. The kinetic model also enabled calculation of hydrogen consumption at various reactor temperatures for the ideal situation wherein the ratio of the rate of hydrogen transfer to the rate of thermal cracking is maintained constant throughout the reactor. As seen in FIG. 2, the curve for hydrogen consumption under ideal conditions in which the abovementioned ratio is constant is significantly lower than for the case in which all of the donor is mixed with the resid charge.

The present invention represents an approach toward the ideal case illustrated in FIG. 2 wherein the ratio of the rate of hydrogen transfer to the rate of thermal cracking is maintained more nearly constant than when all of the donor is mixed with the resid charge as has been done in prior art HDDC processes. The hydrogen consumption is a major factor in the overall operating economy of an HDDC process, and any reduction in hydrogen consumption that can be obtained without sacrificing conversion levels or product quality is obviously to be desired. This invention provides a relatively simple and straight-forward method of obtaining an improvement in hydrogen consumption over that experienced in prior art HDDC processes by distributing the hydrogen donor diluent more uniformly through the cracking furnace such that the ratio of the rate of hydrogen transfer to the rate of thermal cracking more nearly approaches the ideal case. If all of the donor is added with the resid charge, some of the hydrogen will be released from the donor before it can be utilized, and will simply form molecular hydrogen. It is accordingly desirable that the hydrogen from the donor be released relatively uniformly throughout the cracking operation, and this is accomplished by the present invention.

In order to obtain a significant improvement in hydrogen consumption it is necessary to add at least 20 volume percent of the donor diluent at a point downstream from the resid charge inlet. It is preferable that from about 25 to 75 volume percent of the donor diluent be added downstream from the resid charge inlet, and from an operational point of view it is preferable to add from 40 to 60 volume percent of the total donor diluent with the resid charge and the remainder at a point approximately midway through the cracking unit. For example, addition of from 40 to 60 volume percent of the total donor diluent with the furnace charge and from 40 to 60 volume percent of the total donor diluent midway through the cracking unit provides good results with a minumum of complexity. It is theoretically desirable to add the donor diluent in a manner such that the ratio of the rate of hydrogen transfer from the diluent to the rate of cracking is constant throughout the cracking unit. However, from a practical viewpoint such a condition is not easily attained, and the additional improvement in hydrogen consumption over that obtained by injecting part of the diluent midway through the cracking unit probably does not justify the additional operating costs that would be required.

The addition of a portion of the diluent at the cracking unit outlet does not contribute to the improved hydrogen consumption results provided by the invention, but such addition does eliminate the need for a separate quench oil line, as the diluent itself is an acceptable quench oil. As is conventional, the cracking unit effluent is fractionated to recover the desired cracked lighter distillates, and diluent is also recovered by this fractionation step for reuse (after hydrogenation of recovered diluent) in the process.

What is claimed is:

1. In a conversion process wherein a heavy petroleum residuum is subjected to hydrogen donor diluent cracking conditions in the presence of a hydrogen donor diluent material in a cracking unit, the improvement comprising:

adding a first portion of the hydrogen donor diluent to said petroleum residuum as it is charged to said cracking unit, and adding a second portion of the hydrogen donor diluent to said petroleum residuum at a point in said cracking unit downstream from the petroleum residuum inlet thereto.

2. The process of claim 1 wherein the hydrogen donor diluent is introduced to said cracking unit in a manner whereby the ratio of the rate of cracking of said residuum to the rate of hydrogen transfer from said diluent is approximately constant throughout said cracking unit.

3. The process of claim 1 wherein a first portion of said hydrogen donor diluent is introduced into said cracking unit with the petroleum residuum feed, a second portion of said hydrogen donor diluent is introduced into said cracking unit approximately midway therethrough, and a third portion of said hydrogen donor diluent is introduced at or near the outlet of said cracking unit.

4. The process of claim 3 wherein said first portion and said second portion are approximately equal.

5. The process of claim 4 wherein said first portion of said diluent is from 40 to 60 volume percent of the total volume of donor diluent.

* * * * *